US005285129A

United States Patent [19]

Takeda et al.

[11] Patent Number: 5,285,129

[45] Date of Patent: Feb. 8, 1994

[54] SEGMENTED ELECTRON EMISSION DEVICE

[75] Inventors: Toshihiko Takeda, Funabashi; Ichiro Nomura, Yamato; Tetsuya Kaneko, Yokohama; Yoshikazu Banno, Atsugi, all of Japan

[73] Assignee: Canon Kabushiki Kaisha, Tokyo, Japan

[21] Appl. No.: 804,532

[22] Filed: Dec. 11, 1991

Related U.S. Application Data

[63] Continuation of Ser. No. 685,166, Apr. 12, 1991, abandoned, which is a continuation of Ser. No. 357,283, May 26, 1989, abandoned.

[30] Foreign Application Priority Data

May 31, 1988 [JP] Japan ..... 63-131567

[51] Int. Cl.[5] ..... H01J 19/06

[52] U.S. Cl. ..... 313/346 R; 313/103 CM; 313/309

[58] Field of Search ..... 313/444, 446, 103 CM, 313/105 CM, 309, 310, 336, 346 R, 759

[56] References Cited

U.S. PATENT DOCUMENTS

| | | | |
|---|---|---|---|
| 2,185,674 | 1/1940 | Michel | 340/759 |
| 3,703,657 | 11/1972 | Shesser | 340/759 |
| 4,093,562 | 6/1978 | Kishimoto | 313/105 CM |
| 4,325,084 | 4/1982 | van Gorkom et al. | 313/446 |
| 4,766,345 | 8/1988 | Harvey et al. | 340/759 |
| 4,827,177 | 5/1989 | Lee et al. | 313/309 |
| 4,954,744 | 9/1990 | Suzuki et al. | 313/309 |

FOREIGN PATENT DOCUMENTS

| | | | |
|---|---|---|---|
| 0106334 | 8/1981 | Japan | 313/336 |
| 526631 | 11/1976 | U.S.S.R. | 313/309 |

*Primary Examiner*—Donald J. Yusko
*Assistant Examiner*—Brian Zimmerman
*Attorney, Agent, or Firm*—Fitzpatrick, Cella, Harper & Scinto

[57] ABSTRACT

A multiple electron emission device having a substrate, a pair of opposed electrodes disposed on the substrate, and an electron emission section formed with grains between the electrodes. Selected portions of the electron emission section are coated with a conductor, semiconductor or insulating material by mask deposition or the like so as to divide the electron emission section into a dotted or linear array of electron emitting portions.

8 Claims, 6 Drawing Sheets

SEGMENTED ELECTRON EMISSION DEVICE

This application is a continuation-in-part continuation of application Ser. No. 07/685,166 filed Apr. 12, 1991 which is a continuation of application Ser. No. 07/357,283 filed May 26, 1989, both now abandoned.

BACKGROUND OF THE INVENTION

1. Field of the Invention

This invention relates to a multiple electron emission device having surface conduction type emission elements disposed two-dimensionally, and relates more particularly to a multiple electron emission device of this type in which unnecessary portions of electron emitting elements are made incapable of emitting electrons.

2. Description of the Prior Art

Conventional electron emission sources put to practical use as electron emitting devices are based on thermionic emission from a hot cathode or on field effect emission. A hot cathode type of electron emission source emits electrons in such a manner that a large current is made to flow through a filament formed of tungsten or the like so that heat thereby generated gives electrons energy higher than the vacuum level. This type of electron emission source is being put into wide use, but none has yet been designed in the form of a two-dimensional array of electron emitting elements; one electron emission source of this type emits only one electron beam. Another example of practical thermal electron sources is represented by a linear electron source having a straight-line hot filament. This type of electron source, however, is not designed to have an elongated element due to the considerations given to thermal expansion of the filament. A field effect type of electron emission source operating without heating emits electrons in such a manner that an intense electric field is applied from outside to a cathode chip having an acute tip. Electron emission characteristics of this electron source greatly depend upon the shape of the tip, and it is therefore difficult to prepare a plurality of electron emission sources of this type having the same characteristics. Therefore no multiple emission device using field effect electron emission sources has yet been put into practical use.

A type of device is known which, though simple in structure, is capable of emitting electrons (though simple in structure). An example of this device is described on page 1290 of "Radio Engineering Electron Physics" 1965, volume 10, made public by Elinson et al.

The principle of this device is based on a phenomenon whereby electrons are emitted by making a current flow through a thin film formed on a substrate and having a small area in parallel with the surface of the film. Ordinarily, this device is called a surface conduction type emission device (in conformity with the description of the Thin Film Handbook).

Surface conduction emission devices other than the above example which utilize an $SnO_2(Sb)$ film proposed by Elinson have also been proposed: one is based on a thin Au film (G. Dittmar: Thin Solid Films 9,317 (1972)), one based on a thin ITO film (M. Hartwell and C. G. Fonstad: IEEE Trans. ED Conf. 519(1975)), and another is based on a thin carbon film (Hisashi Araki et al.: Vacuum, volume 26, No.1, p, 22 (1983)).

FIG. 8 shows a typical arrangement of an element of these surface conduction emission devices. The element shown in FIG. 8 has electrodes 7 and 8 for electrical connection, a thin film 9 formed of an electron emitting material, a substrate 10, and an electron emitting portion 11.

To use the conventional surface conduction emission device, a process called foaming is previously performed before the operation of emitting electrons. That is, a voltage is applied between the electrodes 7 and 8 to energize the thin film 9 so that the thin film 9 is locally broken, deformed or changed in quality, thereby forming an electron emitting portion 11 having a high electric resistance.

This high-electric-resistance portion is a discontinuous film portion in which a crack having a width of 0.5 to 5 μm is formed in part of the film 9, and a so-called islet structure is formed inside the crack. Ordinarily, in the islet structure, grains having a diameter of several tens of angstroms to several microns exist in the form of a film on the substrate 10 in such a manner that the grains are spatially isolated from each other but are electrically continuous.

The conventional surface conduction emission element emits electrons from such grains when a voltage is applied between the electrodes 7 and 8 so that a current flows through the surface of the element.

The thermionic electron emission entails a problem of energy loss due to heating and, hence, a problem of heat radiation during emission of electrons, resulting in extreme difficulty in arranging a plurality of thermionic electron emission elements on one substrate. A field effect electron emission device necessitates a process of acutely pointing the tip of the cathode chip until the radius thereof becomes several hundred angstroms. This process must include a number of steps including a step of remodeling after the step of performing ordinary polishing, and is highly dependent on empirical factors, the possibility of dispersion of the elements during manufacture being high. It is very difficult to form a plurality of field effect electron emission elements having equal characteristics and to arrange these elements on one substrate. For this reason, no attempt to manufacture a practical electron emission device by providing a plurality of electron emission elements on one substrate has yet been achieved.

The conventional surface conduction emission device necessitates a foaming process during manufacture, and therefore entails the following drawbacks.

1) It is not possible to design the islet structure if electric power energization is adopted for foaming, and it is therefore difficult to improve the properties of the elements as well as to prevent dispersion of the same.

2) The islet structure has a short lifetime and is unstable, and the possibility of the element being broken by external electromagnetic noise is high.

3) Since the islet structure is formed by a foaming process, the degree of freedom with which the material for forming the islet structure can be selected is limited.

4) The shape of the element is limited because local concentration of heat is required in the foaming process.

5) The substrate tends to be broken by local concentration of heat.

Surface conduction emission devices have not been actively utilized by industry, even though they offer the advantage of having a simple structure.

SUMMARY OF THE INVENTION

In view of these problems, an object of the present invention to provide a multiple electron emission device which can be designed to arrange two-dimensionally a plurality of elements on one substrate while the desired reliability of the device is maintained.

Another object of the present invention to provide a multiple electron emission element which can be manufactured by a simple process.

To these end, the present invention provides a multiple electron emission device having a substrate, a pair of opposed electrodes disposed on the substrate, and an electron emission section formed between the electrodes, wherein a coating material is applied to at least a portion of the electron emission section so as to form a plurality of electron emitting portions between the electrodes.

DESCRIPTION OF THE PREFERRED EMBODIMENTS

Figure 1:
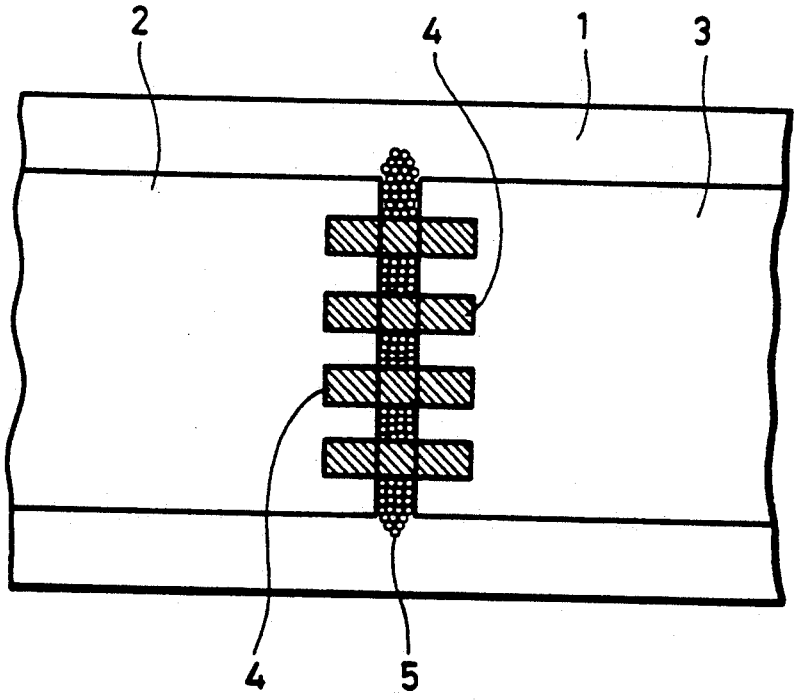
FIGS. 1, 2, 6 and 7 are plan views of embodiments of the present invention.

The present invention is generally intended to provide a means to solve the above-described problems by forming at least one surface conduction emission element on a substrate, and rendering at least part of an emission section of this element incapable of emitting electrons, thereby dividing it into at least two electron emitting portions.

In accordance with the present invention, a dotted, linear or planar electron emission section previously formed is divided into a plurality of pieces by rendering unnecessary portions of the electron emission section incapable of emitting electrons.

None of the conventional practical electron sources can be designed as a multiple type or a planar type owing to problems of heating and/or processing, as mentioned above. A surface conduction emission element that is substantially free from heat evolution and that can be manufactured without any special processing because of its specific structure can be applied as a dotted or linear electron source, but its electron emission characteristics are liable to be influenced by the state and the shape of the surfaces of the islet grains of the islet structure of the electron emitting portion. It is therefore difficult to arrange a pattern formation process suitable for manufacture of a multiple device. For this reason, development of a practical multiple surface conduction emission device has not progressed. However, the inventors of the present invention have eagerly studied and found a means of limiting the emission of electrons by applying a coating material over the electron emitting portion. They have also found that the current flowing through a portion between the electrodes to which the thin film is attached can be eliminated by choice of material.

The present invention has been achieved on the basis of these findings, and a multiple electron emission device in accordance with the present invention has a pair of opposed electrodes formed on a substrate and an electron emission section formed between the electrodes, and a coating material is applied to at least a portion of the electron emission section so that a plurality of electron emitting portions are formed in the gap between the electrodes. To provide a multiple electron emission device having improved reliability in consideration of the problems of the conventional surface conduction emission device that needs to be processed by foaming, it is preferable to design the surface conduction type emission device in such a manner that each electron emitting portion is formed of a thin film containing grains spatially isolated and electrically continuous and is made capable of emitting electrons without being processed by foaming.

The material for forming the electron emitting portion in accordance with the present invention may be selected from borides such as $LaB_6$, $CeB_6$, $YB_4$ and $GdB_4$, carbides such as TiC, ZrC, HfC, TaC, SiC and WC, nitrides such as TiN, ZrN and HfN, metals such as Nb, Mo, Rh, Hf, Ta, W, Re, Ir, Pt, Ti, Au, Ag, Cu, Cr, Al, Co, Ni, Fe, Pb, Pd, Cs and Ba, metallic oxides such as $In_2O_3$, $SnO_2$, $Sb_2O_3$ and $SiO_2$, semiconductors such as Si and Ge, carbon, AgMg and so on. The material to be used is prepared as grains which are applied to and diffused over the surface of the substrate between the electrodes.

The electrodes may be formed of an ordinary conductive material, e.g., a conductive oxide material such as $SnO_2$ or ITO as well as a metal such as Au, Pt or Ag.

Preferably, the thickness of the electrodes is several hundred angstroms to several microns, but it is not limited to this range. The gap between the electrodes is, preferably, several hundred angstroms to several ten microns, and the width of the gap is, preferably, several microns to several millimeters, but the dimensions of the gap are not limited to these ranges.

The substrate is formed from an insulating material such as glass or a ceramic.

The coating material in accordance with the present invention may be a conductor having a resistivity of less than $10^{-2}$ Ω.m, a semiconductor having a resistivity of about $10^{-2}$ to $10^5$ Ω.m, or an insulating material having a resistivity of not less than $10^6$ Ω.m. More specifically, the coating material may be selected from among the metals, i.e., conductors, such as Ag, Cu, Au, Al, Cr, Ti, W, Zn, Ni, In, Pt and Ta, semiconductors such as Si, Ge, Se, B, GaP, GaAs, ZnO, CdS and SiC, and insulating materials such as C, S, $SiO_2$, MgO, $HfO_2$ and HfB, although it is not limited to these substances.

The optimum pattern with which the coating material is applied differs depending upon the kind of the material.

Where an insulating material is used, the resistance of a portion to which the coating material is attached is extremely high, and a current flowing through this portion is very small. The effect of improving the electron emission efficiency ([emission current]/[current flowing through the gap between the electrodes]) is therefore high.

Where a semiconductor is used, the reduction in the current flowing through the gap between the electrodes is smaller than that in the case of the insulating material, while the function of preventing electron emission at the portion to which the coating material is attached is substantially the same as the insulating material. The electron emitting portion is therefore difficult to charge up and the extent of the disturbance to the electric field is effectively reduced, although the effect of improving the electron emission efficiency is lower.

Where a conductive material is used, the same effect of preventing the emission of electrons can also be obtained. However, if the material is applied with a pattern that connects the electrodes across the gap, the resistance between the electrodes becomes extremely small or zero, which state is not preferable. To use a conductive material, it is necessary to consider the manner of attaching the material; the conductive material is applied so as to be electrically insulated from the electrodes. However, the use of a conductive material is otherwise advantageous in practice, since there are many applicable conductive materials and the degree of selection freedom is high.

Whatever the kind of the coating material may be, the thickness of the applied material may be such that all the grains placed in the electron emitting portion are thoroughly embedded in the material.

Specifically, the effects of the coating are sufficient if the thickness thereof is equal to or larger than the diameter of the grains, i.e., several microns to several ten microns. In a case where grains having a particle size of 80 to 100 Å are used to form the electron emitting portion, it is practically sufficient to attach a thin film having a thickness of at least 100 Å. Even if the thickness of the thin film is larger than 1000 Å, the effects of the resulting device are substantially the same. The upper bound of the thickness is not specifically limited and may be selected in consideration of facility of manufacture, although the film thickness is preferably 100 Å to 1000 Å.

Figure 6:
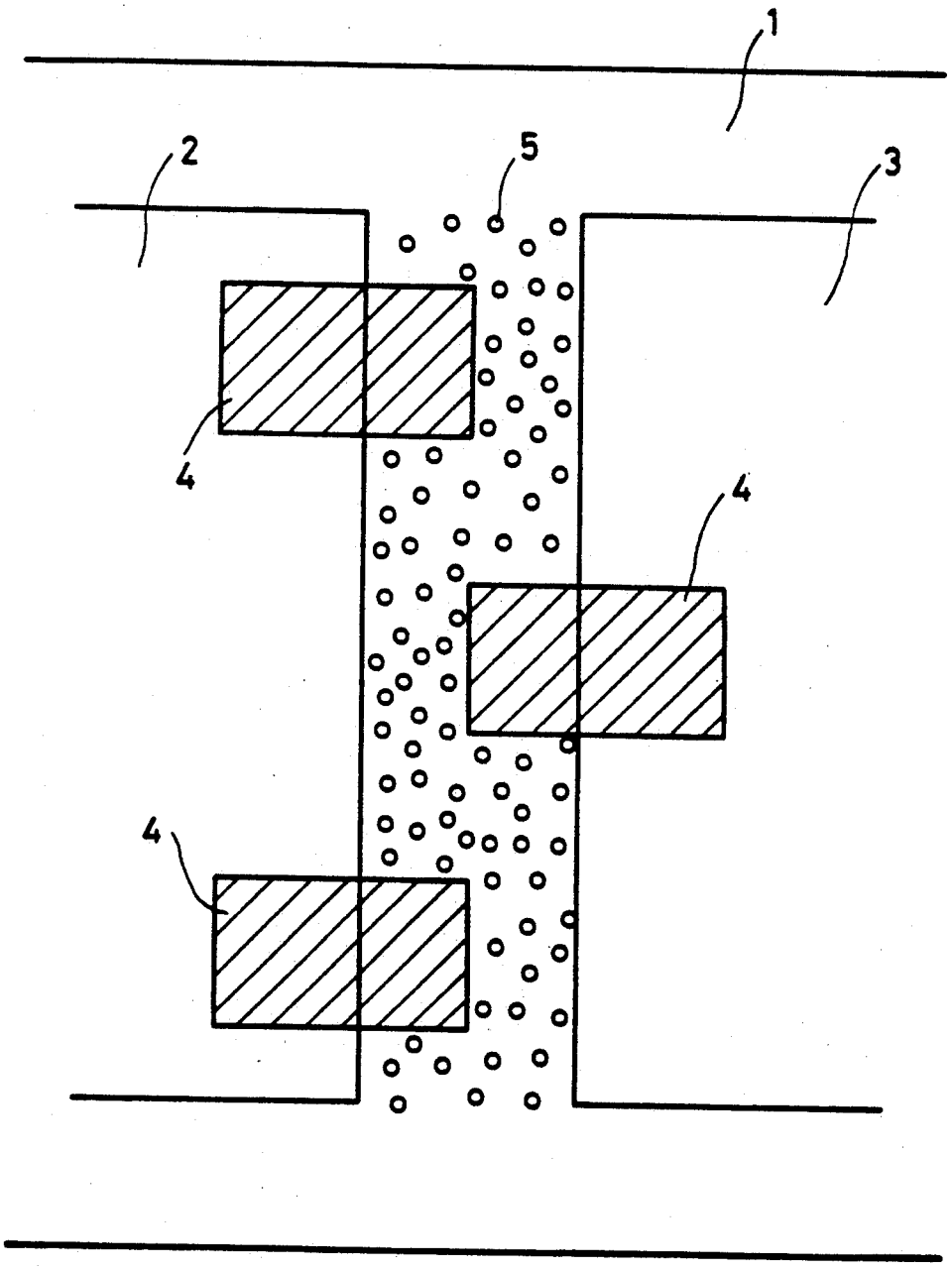
Figure 7:
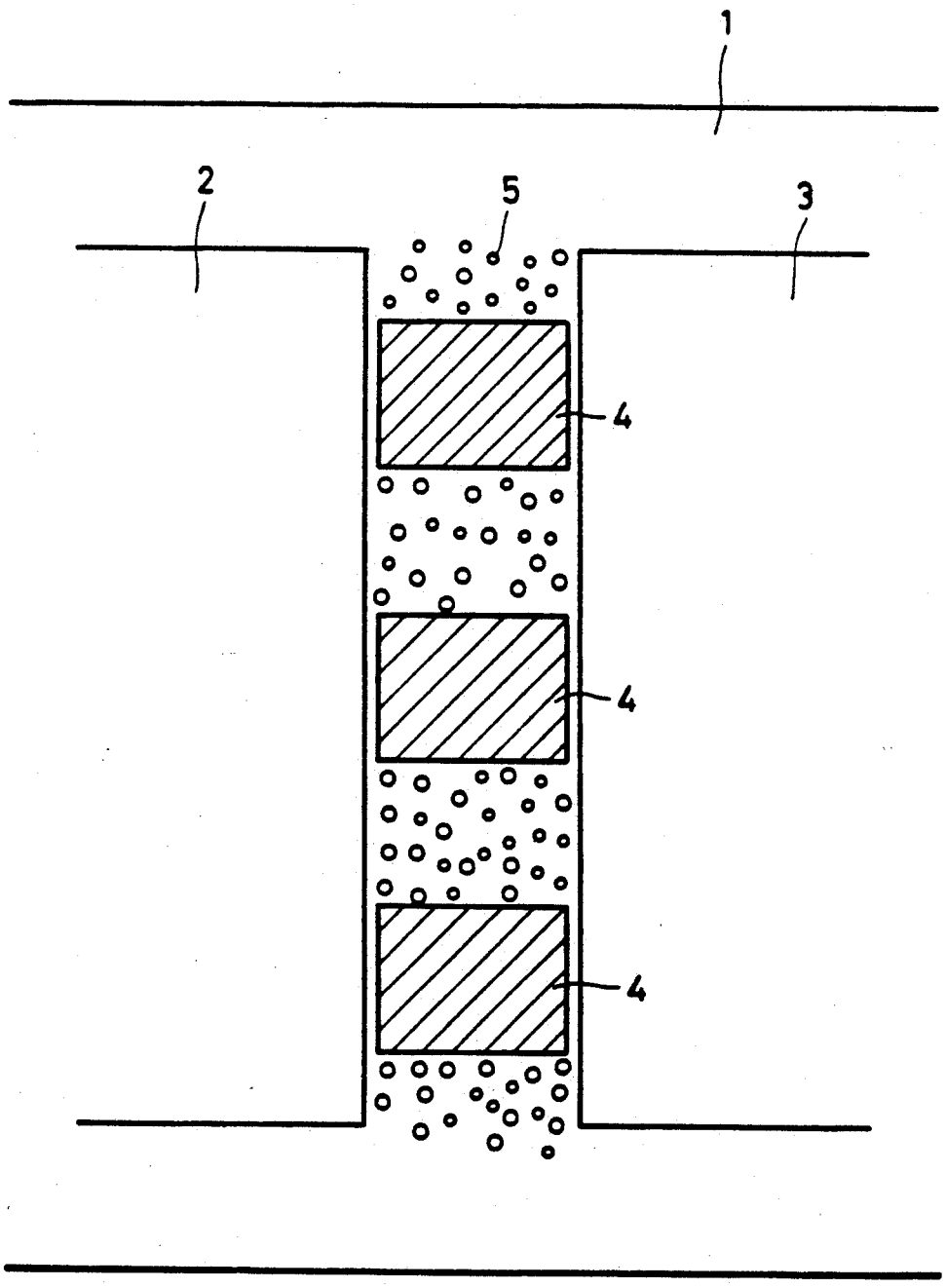
Figure 8:
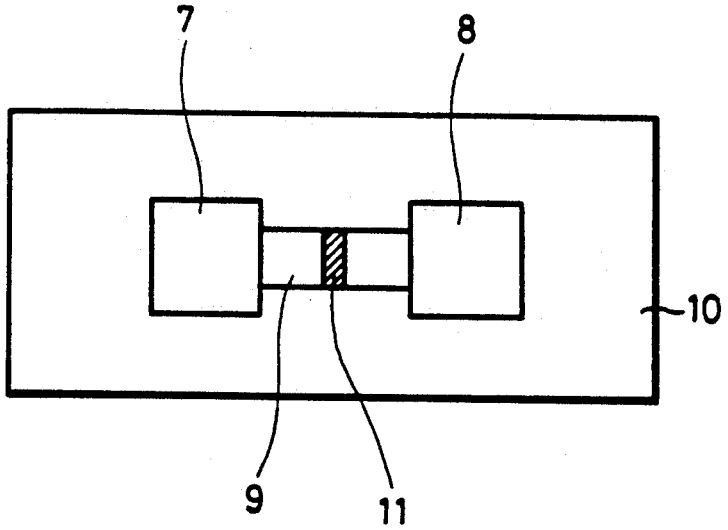
FIG. 8 PRIOR ART
FIG. 8 is a diagram of conventional art.

In a case where a coating material 4 is applied in such a manner that, as shown in FIG. 6, each coating layer contacts one of a pair of electrodes 2 and 3 which define a linear emission section, or in a case where, as shown in FIG. 7, the coating material 4 is applied so as be located only at the gap, it is possible to divide the emission section into dotted or linear electron emitting portions of a desired size.

In the case of the arrangement of the coating material 4 shown in FIG. 6, it is not desirable to use a conductive material as the coating material 4. In the case of the arrangement shown in FIG. 7, any one of the conductor; the coating material can freely be selected from conductors, semiconductors and insulating materials.

The present invention is applicable to various surface conduction type emission devices each having an islet structure of electron emitting portions. It is specifically effective when applied to a type of device in which grains 5 provided between the electrodes 2 and 3 are exposed out of the surface of the device, but it not effective with respect to a type of device in which grains 5 are not exposed out of the surface of the device but are covered with a thin film of a conductor, semiconductor or insulating material to have an electron emitting function

EMBODIMENT 1

Embodiments of the present invention will be described below in detail with reference to the accompanying drawings. FIG. 1 is a top view of a multiple electron emission device which represents an embodiment of the present invention. The device shown in FIG. 1 has an insulating substrate 1 formed from, e.g., glass, a pair of electrodes 2 and 3 spaced apart from each other to form a small gap, a coating material 4 for eliminating an electron emitting function, and grains placed in the gap.

To manufacture this type of device, nickel electrodes 2 and 3 were first formed by vacuum deposition and by the ordinary photolithography technique on a quartz substrate (2 inch square) 1 sufficiently degreased and washed while being spaced apart from each other by a small distance of 2 μm. Each electrode had a width of 10 mm. An organic solvent containing organic palladium was applied in a rolling manner to the substrate on which the electrodes had been formed, followed by baking at 300° C. for 10 minutes, thereby forming a linear electron emission section having a width of 10 mm. MgO was thereafter deposited by electron beam deposition on the electron emission section having a width of 10 mm with a 1 mm pitch grating deposition mask until the thickness of the deposited MgO layer became equal to 300 Å. The electron emission section was thereby divided into ten parts, thereby completing the device.

This device was placed in a vacuum chamber maintained at a pressure of about $1\times10^{-6}$ Torr, a voltage of 14 V was applied between the electrodes 2 and 3 while a fluorescent screen to which a voltage of 1 kV was applied was placed above the device at a distance of 5 mm therefrom in the vertical direction, thereby emitting electrons. Ten luminous points were recognized at ten places on the screen corresponding to the emitting portions of the device. At this time, the total emission current was about 10 μA.

A layer of amorphous carbon having a thickness of 500 Å was formed in place of MgO in the same pattern by sputtering deposition. The same experiment was made with respect to the device thereby obtained. The results of experiment were the same as in the case of MgO.

The same experiment was also made by using aluminum as the coating material. The pattern of aluminum was such that, as shown in FIG. 7, the coating material was formed within the linear emission section so that the coating material did not contact the electrodes 3 and 4. The gap between the electrodes was 5 μm, and deposited aluminum layer having a width of 2 μm were formed with a 500 μm pitch in the gap by the ordinary photolithography technique.

During emission of electrons from this device in vacuum, no electron was emitted from the portions coated with aluminum, thereby confirming that patterning of the linear emission section was possible.

The same experiment was made using silicon in place of aluminum. As a result, patterning was possible with respect to each of the types shown in FIGS. 6 and 7.

Thus, the samples were manufactured by using the insulating material, the conductive material and the semiconductor as the coating material with the patterns suitable for the respective materials. It was thereby found that each of these materials could be applied to the multiple electron emission device.

EMBODIMENT 2

Figure 2:
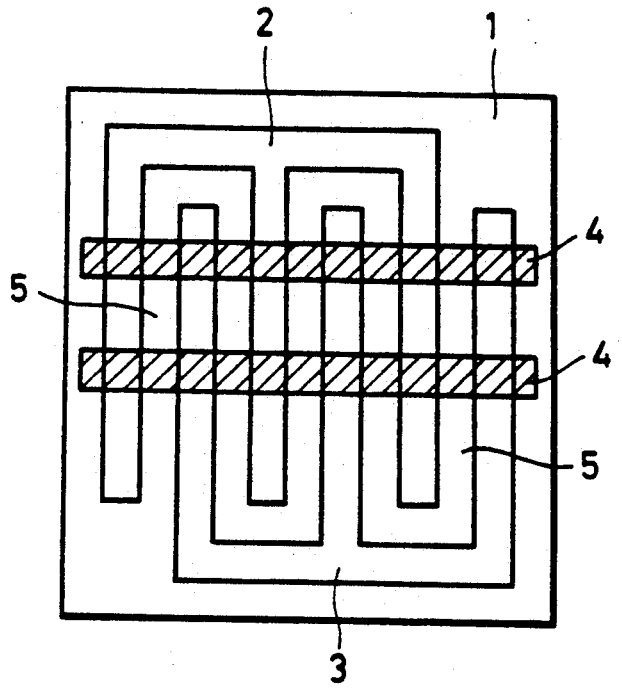

FIG. 2 is a schematic plan view of another embodiment of the present invention. As shown in FIG. 2, a positive electrode 2 and a negative electrode 3 each having a width of 1 mm were formed by the ordinary photolithography technique on a 5 cm square quartz substrate 2 sufficiently degreased and washed. The electrodes were formed from nickel and had a comb-like shape, the gap between the electrodes was 2 μm, and the thickness of the electrodes was about 1000 Å.

Next, an organic solvent containing organic palladium (Catapaste - CCP, product of Okuno Chemical Industries Co. Ltd.) was applied in a rolling manner to the substrate 1 on which the electrodes 2 and 3 had been formed, followed by baking at 300° C. for 10 minutes, thereby forming a linear electron emission sections.

MgO was thereafter deposited by mask deposition on the electron emission section until the thickness of the deposited MgO layer became equal to about 100 Å. The mask was in the form of a 250 μm pitch grating and was used in such a manner that the electrode pattern and the mask pattern met at right angles. Therefore the linear electron emission section on the substrate 1 were divided at the MgO coating strips 4 each having a width of 250 μm, and 40×100 small electron emitting portions each having a size of 2×250 μm were thereby formed like a matrix. The resistivity of MgO is about $10^6$ Ω.m.

Figure 3:
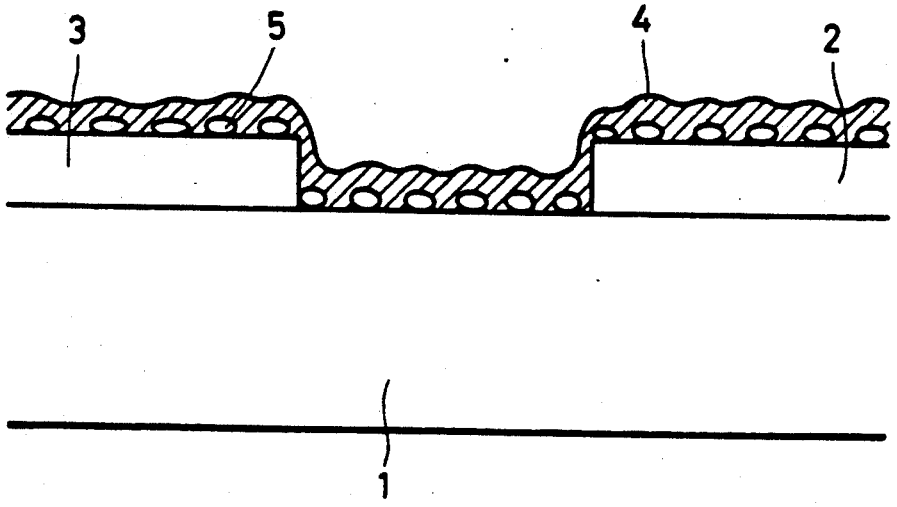
FIG. 3 is a cross-sectional view of an electron emitting portion of the embodiment.

FIG. 3 shows in section a portion of the matrix-like electron source to which MgO is attached. It was confirmed that the diameter of the Pd grains obtained by baking was about 50 to 80 Å and that Pd grains in the 100 Å MgO layer were completely covered with MgO.

The thus-manufactured device was placed in a vacuum chamber maintained at a pressure of about $5\times10^{-6}$ Torr, and a voltage of 14 V was applied between the electrodes 2 and 3, thereby performing an electron emission test. The emission of electrons was confirmed by using a fluorescent screen, and the pull-out voltage was 1 kV. Luminous points on the fluorescent material were observed as an array of dots corresponding to the pattern of the electron emitting portions. The total emission current Ie corresponding to the emission from all the small electron emitting portions arranged on the substrate 1 was about 320 μm, and the current with respect to each electron emitting portion was about 100 nA. To confirm the effects of MgO, MgO was vacuum-deposited on an electron emitting portion of a conventional surface conduction type electron emission element formed by foaming. No current flowed through the element in which MgO was deposited over the electron emitting portion, and no electrons were emitted.

EMBODIMENT 3

Figure 4:
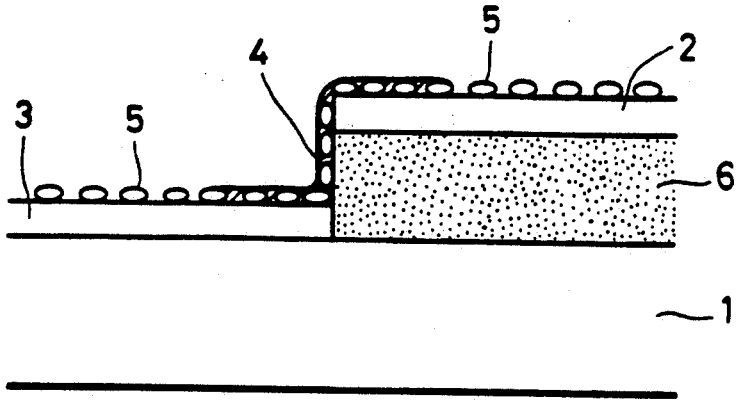
FIGS. 4 and 5 are a longitudinal cross-sectional view and a plan view of an electron emitting portion of another embodiment of the present invention.
Figure 5:
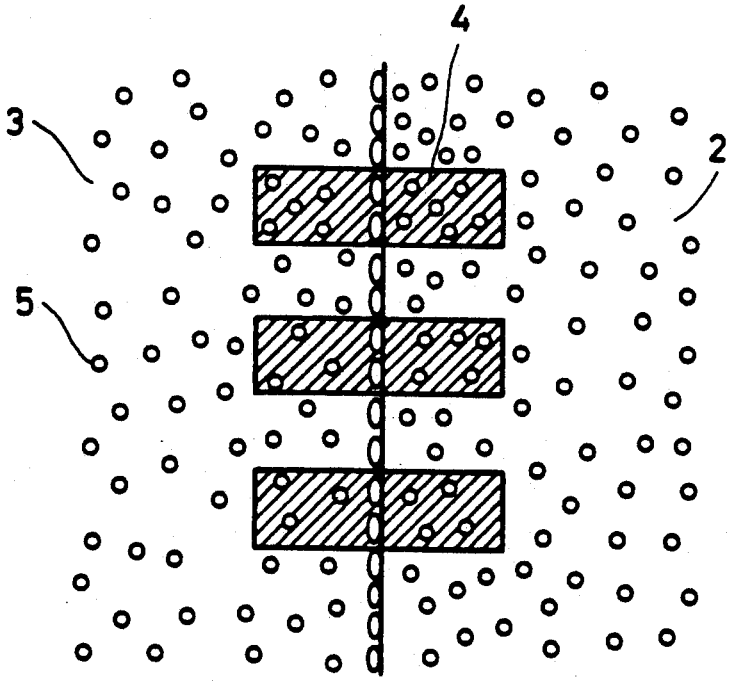

FIG. 4 schematically shows in section another multiple electron emission device manufactured in accordance with the present invention, and FIG. 5 is a top plan view of this device. The device is constituted by a quartz glass substrate 1, nickel electrodes 2 and 3, palladium grains 5 and an $HfO_2$ coating material 4.

A $SiO_2$ insulating layer 6 for forming a difference in level and having a thickness of 1500 Å was first formed by the CVD method over one of two major surfaces of the quartz substrate 1 sufficiently degreased and washed. Next, part of the $SiO_2$ insulating layer 6 was removed by the ordinary photolithography technique, thereby forming a stepped shape. On the substrate having a difference in level thereby provided, electrodes 2 and 3 were formed by vacuum deposition of nickel over the whole surface. The thickness of each of the electrodes 2 and 3 was about 1000 Å. Deposition was performed while the substrate 1 was inclined in order to prevent nickel from attaching the side surface of the stepped portion.

Next, an organic solvent containing organic palladium (Catapaste - CCP, product of Okuno Chemical Industries Co., Ltd.) for forming electron emitting portions was applied in a rolling manner with a spin coater, followed by baking at 250° C. for 10 minutes, thereby forming grains 5 of palladium over the side surface of the $SiO_2$ layer between the electrodes 2 and 3. The thus-manufactured element had a linear electron emission section constituted by the electrodes 2 and 3, the $SiO_2$ insulating layer 6 and palladium grains 5.

$HfO_2$ was thereafter deposited by EB deposition with a grating-like mask for dot patterning of the linear electron emission section until the thickness of the deposited $HfO_2$ layer became equal to about 100 Å, thereby making part of the electron emission section incapable of emitting electrons.

The the thus-manufactured device had 100 dot-like electron emitting portions arranged on the substrate 1. An electron emission test was performed in vacuum in the same manner as the former embodiments. As a result, the total emission current Ie for 100 elements was 100 μA.

Thus, the present invention is based on a manufacture method in which the electron emitting function of some portions of an electron emission section are eliminated by attaching thin film material 4 thereto so that dotted, linear electron emitting portions are formed, and the present invention has the following advantages.

1) The reproducibility of the desired structure is high because patterning can be effected with an extremely thin film in a mask deposition manner or the like.

2) No current flows through the portion to which the coating material 4 is attached, thereby enabling an improvement in the emission efficiency.

In accordance with the present invention, as described above, a surface conduction type emission device which can be designed to two-dimensionally arrange a plurality of elements on one substrate and which is capable of operating with improved reliability.

What is claimed is:

1. A multiple electron emission device comprising:

a substrate, a pair of opposed electrodes disposed on a surface of said substrate, and a non-separated electron emission section formed between said electrodes, wherein a coating material is applied on a surface of said electron emission section so as to divide said electron emission section formed between said electrodes into a plurality of separated electron emitting segments, and wherein said electrodes apply a voltage to said electron emission section.

2. A multiple electron emission device according to claim 1, wherein the thickness of a layer formed by applying said coating material is 100 to 1000 Å.

3. A multiple electron emission device according to claim 1, wherein said coating material is a conductor having a resistivity ρ smaller than $10^{-2}$ Ω.m.

4. A multiple electron emission device according to claim 3, wherein said conductor is applied to said electrodes while being electrically insulated from at least one of said electrodes.

5. A multiple electron emission device according to claim 1, wherein said coating material is a semiconductor having a resistivity ρ: $10^2$ Ω.m≦ρ≦$10^5$ Ω.m.

6. A multiple electron emission device according to claim 1, wherein said coating material is an insulator having a resistivity ρ larger than $10^6$ Ω.m.

7. A multiple electron emission device according to claim 1, wherein said electron emission section is formed of a thin film containing grains.

8. A multiple electron emission device according to claim 1, wherein the electron emitting characteristics of all of said electron emitting segments are substantially uniform.

* * * * *

UNITED STATES PATENT AND TRADEMARK OFFICE

CERTIFICATE OF CORRECTION

PATENT NO. : 5,285,129

DATED : February 8, 1994

INVENTOR(S) : TOSHIHIKO TAKEDA ET AL.

It is certified that error appears in the above-identified patent and that said Letters Patent is hereby corrected as shown below:

COLUMN 1

Line 4, "continuation-in-part" should be deleted.
Line 48, "electrons (through sim-" should read --electrons.--.
Line 49, "ple in structure)." should be deleted.
Line 66, "p, 22" should read --p. 22--.

COLUMN 3

Line 7, "end," should read --ends,--.

COLUMN 5

Line 48, "it not" should read --it is not--.
Line 53, "tion" should read --tion.--.

COLUMN 7

Line 9, "were" should read --was--.

UNITED STATES PATENT AND TRADEMARK OFFICE

CERTIFICATE OF CORRECTION

PATENT NO. : 5,285,129

DATED : February 8, 1994

INVENTOR(S) : TOSHIHIKO TAKEDA ET AL.

It is certified that error appears in the above-identified patent and that said Letters Patent is hereby corrected as shown below:

COLUMN 8

Line 8, "the" should be deleted.

Signed and Sealed this

Twenty-seventh Day of September, 1994

*Attest:*

Bruce Lehman

BRUCE LEHMAN

*Attesting Officer*

*Commissioner of Patents and Trademarks*